US005594223A

United States Patent [19]

Fukushi et al.

[11] Patent Number: 5,594,223

[45] Date of Patent: Jan. 14, 1997

[54] VACUUM SWITCH BULB TYPE CHANGE OVER SWITCH FOR ON-LOAD TAP CHANGER

[75] Inventors: Akira Fukushi; Tomio Yamaguchi, both of Kawasaki, Japan

[73] Assignee: Fuji Electric Co., Ltd., Kawasaki, Japan

[21] Appl. No.: 352,075

[22] Filed: Nov. 30, 1994

[30] Foreign Application Priority Data

Dec. 7, 1993 [JP] Japan ..... 5-305644

[51] Int. Cl.[6] ..... H01H 33/66

[52] U.S. Cl. ..... 218/120; 200/11 TC; 200/400

[58] Field of Search ..... 200/11 R, 11 TC, 200/17 R, 400; 218/1, 2, 4–10, 14, 118–120, 139, 140, 152–154

[56] References Cited

U.S. PATENT DOCUMENTS

| | | | |
|---|---|---|---|
| 3,783,206 | 1/1974 | Lingenfelter | 200/11 TC |
| 3,935,407 | 1/1976 | Bleibtreu et al. | 200/144 B |
| 4,220,837 | 9/1980 | Bice | 200/146 R |
| 4,520,246 | 5/1985 | Yoshii et al. | 200/144 B |
| 5,488,212 | 1/1996 | Fukushi et al. | 200/400 |

*Primary Examiner*—Michael L. Gellner
*Assistant Examiner*—Michael A. Friedhofer
*Attorney, Agent, or Firm*—Kanesaka & Takeuchi

[57] ABSTRACT

A vacuum switch bulb type change over switch of the invention is used for an on-load tap changer for changing over from a tap to a tap in an on-load state. The change over switch is formed of a plurality of single phase switch cassettes, and a common controller for the switch cassettes. Each cassette includes a plurality of vacuum switch bulbs and a plurality of coupling devices for the vacuum switch bulbs. The common controller includes a plurality of holding devices for holding the vacuum switch bulbs in an opened or a closed state to thereby hold the taps in predetermined states. The single phase switch cassettes are independently mounted on and coupled with the common controller through the holding device.

10 Claims, 4 Drawing Sheets

Fig. 3
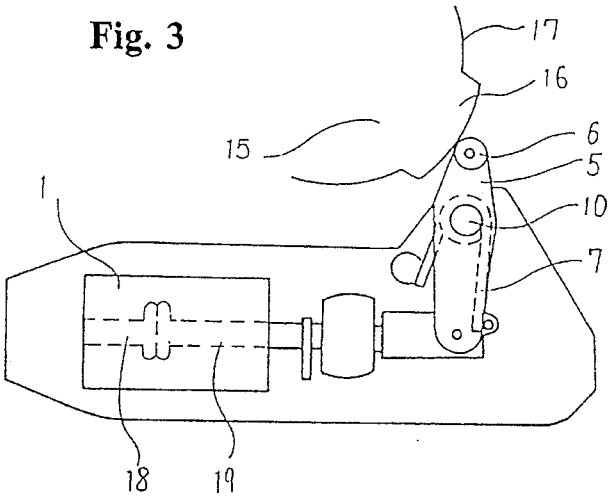
Fig. 4
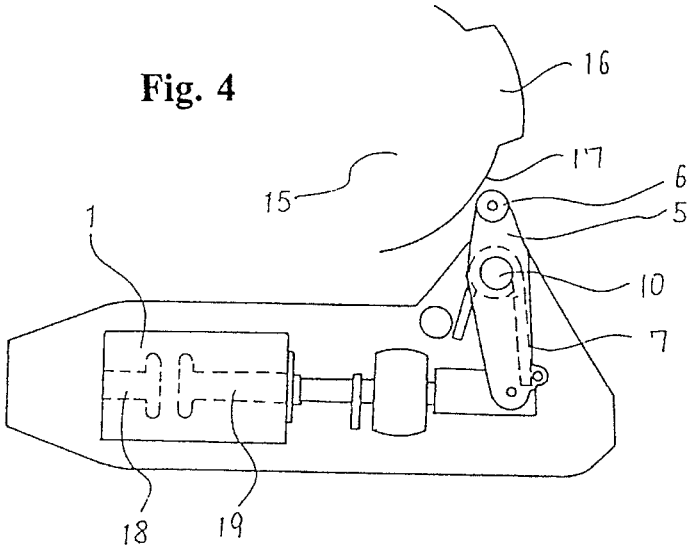
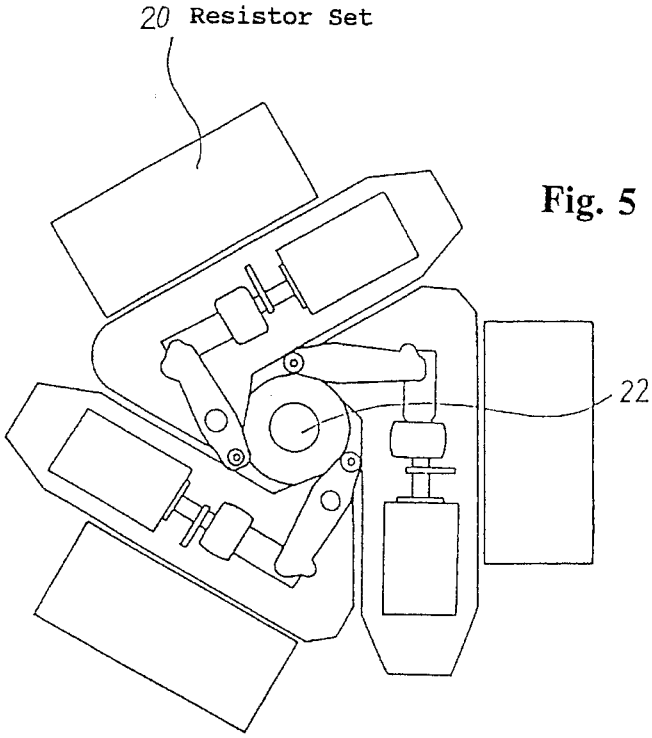
Fig. 5

VACUUM SWITCH BULB TYPE CHANGE OVER SWITCH FOR ON-LOAD TAP CHANGER

BACKGROUND OF THE INVENTION AND RELATED ART STATEMENT

The present invention relates to a change over switch for an on-load tap changer or change over switch for changing over taps of the transformer wiring or a the reactor wiring under loading or on-load state, more specifically, to a vacuum switch bulb type change over switch for an on-load tap changer, wherein vacuum bulbs or vacuum switch bulbs are used for current on-off contact points to be switched on and off for changing over the taps. In this system, three vacuum switch bulbs are used in a single resistor type for a single phase, and four vacuum switch bulbs are used in a double resistor type for a single phase, so that in a three phase switch, triple number of the vacuum switch bulbs is used.

FIG. 6 shows a structure of a conventional on-load tap changer (hereinafter sometimes referred to as "tap changer"), which uses a vacuum bulb type or vacuum switch bulb type change over switch. The tap changer is formed of a tap selector 210 disposed between a transformer wiring or a reactor wiring and a neutral point of a transformer, and a change over switch 207. The tap selector 210 further includes a tap selector drive mechanism 210A which performs a tap selection operation, and the change over switch 207 further includes a stored energy quick breaker 207A which changes over the taps of the change over switch 207.

The tap selector 210 and the change over switch 207 are vertically integrated together and hung in a transformer tank. The driving force is supplied to the stored energy quick breaker 207A and the tap selector drive mechanism 210A from a motor mounted in an electric actuator 201 via a speed reducer (not shown, a vertical drive shaft 202, a bevel gear 203, a horizontal drive shaft 204, a bevel gear 205, and an insulative drive shaft 206. The torque transferred to the insulative drive shaft 206 from the motor is transferred also to a tap selector drive shaft 210B coaxially aligned with the insulative drive shaft 206 via a crank 207D1 of the stored energy quick breaker 207A, which will be explained later. The on-load tap change over operation by the above described tap changer is performed as follows.

When a tap change over command is fed to an electric actuator 201, a motor mounted in the electric actuator 201 starts, and the torque of the motor is transferred to the insulative drive shaft 206 via a speed reducer (not shown), the vertical drive shaft 202, the bevel gear 203, the horizontal drive shaft 204, and the bevel gear 205. The torque transferred to the insulative drive shaft 206 is also transferred to the tap selector drive shaft 210B via the crank 207D1 rigidly coupled with the insulative drive shaft 206 to thereby transfer the driving force to the tap selector drive mechanism 210A, so that the tap selector 210 performs the tap selection operation.

At the same time, the crank 207D1 rigidly coupled with the insulative drive shaft 206 rotates around a rotation axis of the insulative drive shaft 206 and pulls a connector bar 207D2. As a result, an input plate 207D4 is rotated clockwise or counterclockwise direction around a rotation axis 207D3 to expand a tension spring 207D5 for energy storage. When the input plate 207D4 rotates beyond a predetermined angle, a clutch for preventing rotation of an output plate 207D6 comes off. Then, the output plate 207D6 rotates around its rotation axis 207D3, and the torque is transferred to a cam shaft 207B via an output shaft 207D7 and a clutch 207D8. Four cam plates 207B*a* are mounted on the cam shaft 207B, and four cranks (not shown) connected to the respective cam plates 207B*a* switch on or off corresponding vacuum switch bulbs 207E in a predetermined order, i.e. sequentially, by the drive spring to thereby complete the tap change operation. The sequential operation of the four vacuum switch bulbs 207E is shown in FIG. 7 together with the operation of the tap selector 210.

FIG. 7 illustrates operations of the tap selector 210 and the change over switch 207 for changing over from an operation using a tap T3 of a tap wiring St of a transformer or a reactor to an operation using a tap T4. When a tap change over command is fed to the electric actuator 201 (FIG. 6), the torque of the motor is transferred to the insulative drive shaft 206 and the torque is further transferred to the tap selector drive shaft 210B via the crank 207D1. Then, the tap selector 210 operates at first, and the tap at the even number side (FIG. 7) in the tap selector 210 is changed over from T2 to T4. This tap selection operation is performed by a Geneva mechanism, which is an intermittent motion mechanism installed on the tap selector drive mechanism 210A, and completed in an early stage of the rotation of the tap selector drive shaft 210B. Then, a change over operation of the change over switch 207, i.e. sequential operation of the four vacuum switch bulbs 207E, is awaited.

In the stored energy quick breaker 207A for driving the change over switch 207, since it takes time to store energy to the tension spring 207D5, as described above, the tap selection operation of the tap selector 210 has been completed at the time that the expansion of the tension spring for energy storage 207D5 reaches a predetermined value. In this condition, the change over operation from the tap T3 to the tap T4 is performed.

In this state, vacuum switch bulbs V1 and V3 on the side of the tap T3 are closed as shown in FIG. 7(A). The cam shaft 207B starts rotating when the expansion of the tension spring 207D5 reaches the predetermined value and the clutch for preventing rotation of the output plate 207D6 comes off. By the differences of shifting portions of the cam plates around the shaft changing from a convex portion to a concave portion or vice versa in the respective four cam plates 207B*a* fixed to the cam shafts 207B, at first the vacuum switch bulb V1 is switched off as shown in FIG. 7(B), and a vacuum switch bulb V4 is switched on (FIG. 7(C)). Then, the vacuum switch bulb V3 is switched off, and finally a vacuum switch bulb V2 is switched on, by which the change over from the tap T3 to the tap T4 is completed. In FIG. 7, a symbol R designates a current limiting resistor. It takes a very short period of time for the vacuum switch bulbs to complete the sequential operation in the order of V1, V4, V3, V2 after the cam shaft 207B starts rotation, and the sequential operation is completed within 0.1 second.

In the change over switches for the on-load tap changer, the vacuum switch bulbs are used for the current on and off contact points, wherein the current switching is made in a vacuum condition, so that $SF_6$ gas or insulator oil of the transformers or the reactors, in which the vacuum switch bulbs are immersed, is not deteriorated by the arc. Thus, many change over switches have been manufactured. Three vacuum switch bulbs are used in a single resistor type for a single phase, and four vacuum switch bulbs are used in a double resistor type for a single phase, so that nine or twelve vacuum switch bulbs are used in a three phase switch.

Conventionally, as shown in FIG. 6, the vacuum switch bulbs are mounted one by one in a casing 207C to constitute a change over switch, or a vacuum switch bulb is incorporated with its accessories into a unit and a plurality of the units is assembled to a change over switch. In a special case, for example, in order to solve the specific drawback occurring at the time of a change over operation, e.g. in a switch having a quick break mechanism, since the on-switching is performed by a strong spring of the quick break mechanism when the vacuum switch bulb is switched on, the contacts of the vacuum switch bulb chatter to cause quick wear of the contacts of the bulbs. Thus, as proposed in Japanese Patent Publication (KOKAI) 61-160918, a vacuum bulb for one phase and a space for means to solve the problem which occupies the same space with that of the vacuum switch bulb are united together in a single phase unit, and the means includes a function for driving its vacuum switch bulbs for one phase in a predetermined order.

The conventional change over switches, wherein the vacuum switch bulbs are installed one by one in a casing, or a plurality of units, each including a vacuum switch bulb and its accessories, is installed one by one in a casing, are complicated in the entire structure. Further, it requires tremendous manpower and time for taking out or installing the components and parts at the time of routine inspection or trouble shooting.

In view of the foregoing, an object of the present invention is to provide a vacuum switch bulb type three phase switch for an on-load tap changer, which is compact and requires little manpower and time for routine inspection and trouble shooting.

SUMMARY OF THE INVENTION

In order to achieve the object of the present invention, a main body of a vacuum switch bulb type change over switch for three phases is formed of a common controller provided with holding means for holding taps in a predetermined condition by holding vacuum switch bulbs for the three phases in an opened or closed state, and three cassette or cassette assemblies, each of which includes vacuum switch bulbs for one phase to have coupling means with the common controller holding means. The three cassettes are independently installed on the common controller without mutual relationships.

In the change over switch, the common controller having the holding means for holding the vacuum switch bulbs for the three phases in either an open or closed state is formed of a cam shaft having a plurality of cam plates as the holding means on one shaft. The three cassettes are mounted side by side on a periphery of the cam shaft. The vacuum switch bulb is formed of a movable contact and a fixed contact.

It is further preferable to align the vacuum switch bulbs for a single phase parallel in a plane in the single phase switch cassette. The single phase switch cassette is preferably formed of a column arranged parallel to an alignment direction of the vacuum switch bulbs; wiping springs, each of which is disposed on each of the vacuum switch bulbs, for pressurizing the movable contact to a fixed contact; and cam levers, rotatably mounted on the fixed column, for deforming the wiping springs to bring the movable contact to contact with the fixed contact. The coupling means is formed of a cam follower disposed to the cam lever to be coupled with the cam plate of the holding means.

The single phase switch cassette is preferably formed of a mounting portion for temporarily mounting jigs for deforming the wiping springs to bring the movable contact to contact with the fixed contact and to position the cam follower on a portion of the cam plate for holding the vacuum switch bulb in a closed state. The jig is preferably formed of a pushing screw for compressing the wiping spring.

The change over switch formed of three single phase switch cassettes (hereinafter simply referred to as "switch cassette") and a common controller onto which the switch cassettes are mounted independently facilitates assembly of the change over switch as well as assembly of the switch cassettes and the common controller. Since the switch cassettes can be dismounted independently from the common controller and inspected one by one or at the same time, the routine inspection can be conducted easily and quickly without causing mixing up of the constituent components and parts, and mis-assemble. Since only a fault cassette can be replaced by a spare cassette, trouble shooting is completed in a short period of time.

The change over switch, in which the common controller is formed of a cam shaft, each of the holding means is formed of a cam plate mounted on the cam shaft and three cassettes are mounted on a periphery of the cam shaft, is assembled quite compactly, because three cassettes are mounted side by side around the long cam shaft of the common controller with a small diameter.

The switch cassette, in which the vacuum switch bulbs are aligned parallel in a plane, is flat in the direction of the thickness (perpendicular to the vacuum switch bulb) and short in the alignment direction of the vacuum switch bulbs (width direction perpendicular to the vacuum switch bulb). By mounting the flat switch cassette in the direction of the length (direction along the vacuum switch bulb) parallel to the circumferential direction of the cam shaft, the dimensions of the change over switch can be reduced in the radial and axial directions of the cam shaft.

Though the movable contact of the conventional change over switch, which is used to accelerate its constituent members and receives contact pressure by a strong drive spring of the quick break drive mechanism, often chatters with the fixed contact when the contacts are brought into contact, the chattering is prevented by the change over switch of the present invention, which is performed through a wiping spring and life of the contacts is prolonged. The wiping spring is preferable, because a compression coil spring is usually used as the wiping spring, which is simply sandwiched between the movable contact and a spring bed provided to the movable member of the quick break mechanism with one end contacting with the movable contact and the other end contacting with spring bed.

The movable contact is driven via the movable member of the quick break drive mechanism and the wiping spring. Only the wiping spring recoils after colliding against the fixed contact without resonating with the movable member of the quick break drive mechanism, because the movable contact is not directly connected with the movable member of the quick break drive mechanism. Chattering of the movable contact ceases quickly even when the spring bed continues chattering with the movable member, because the resonance frequency of the wiping spring is high and because the resonance frequency determined by the parameters of the wiping spring and the mass of the movable contact is different from the resonance frequency of the drive spring and the movable member. Thus, the wiping spring disposed between the movable contact and its driving member suppresses chattering and prevents the change over switch from increase of its dimensions.

On the other hand, the wiping spring makes it difficult for the cam follower to be coupled with a portion of the cam plate for holding the vacuum switch bulb in a closed state. As described earlier, the cam follower is disposed on the top of the cam lever as a movable contact driving member rotatably mounted on a column of the switch cassette, and a plurality of cam plates is mounted on the cam shaft of the common controller. The aforementioned difficulty is avoided by providing the switch cassette with a mounting portion for temporarily (during the change over switch assembly) mounting jigs for compressing the wiping springs. The jig is preferably a pushing screw. During assembly of the change over switch, the vacuum switch bulb is closed by the pushing screw compressing the wiping spring, by which the cam follower is easily coupled with the cam plate.

BRIEF DESCRIPTION OF THE DRAWINGS

FIG. 3 is an explanatory drawing for explaining coupling between a cam follower of the vacuum switch bulb and a cam plate mounted on a cam shaft of a common controller when the vacuum switch bulb is closed;

FIG. 4 is a explanatory drawing for explaining coupling between the cam follower and the cam plate when the vacuum switch bulb is opened;

FIG. 5 is a top plan view showing a three phase change over switch assembly for an on-load tap changer formed of the vacuum switch bulb cassettes according to the present invention;

DETAILED DESCRIPTION OF PREFERRED EMBODIMENTS

The present invention will be explained hereinafter with reference to the accompanied drawings, which illustrate preferred embodiments of the present invention.

As described earlier, three vacuum switch bulbs are used in a single resistor type single phase switch, and four vacuum switch bulbs are used in a double resistor type single phase switch. The present invention will be explained by an embodiment of a double resistor type single phase switch using four vacuum switch bulbs for one phase.

Figure 1:
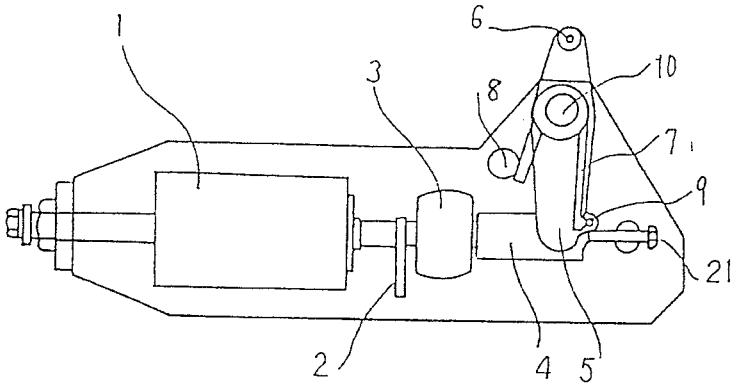
FIG. 1 is a top plan view showing a structure of a vacuum switch bulb cassette according to the present invention.

FIG. 1 is a top plan view of a single phase switch assembly (single phase switch cassette or switch cassette), which is prefabricated to house four vacuum switch bulbs for one phase and is mounted onto a common controller provided commonly to the three phases. In the figure, a reference numeral 1 designates a vacuum switch bulb; 2 is a current terminal on the side of a movable contact; 3 is an insulator; 4 is a wiper fitting for housing a wiping spring (not shown) for pressing a movable contact onto a fixed contact of the vacuum switch bulb; and 5 is a cam lever which rotates around a column 10 and drives the movable contact of the vacuum switch bulb.

A cam follower 6 to be coupled with a cam plate of a cam shaft constituting the common controller (not shown) provided commonly to the three phases is connected to the top of the cam lever 5. A torsion spring 7 for breaking the vacuum switch bulb 1 is wound in several turns around the column 10 between a spring stopper screw 9 and a spring stopper column 8. When the cam follower 6 of the cam lever 5 is positioned on the concave portion (not shown) of the common controller, the contacts of the vacuum switch bulb 1 are always separated from each other by the restoring force of the torsion spring 7.

Figure 2:
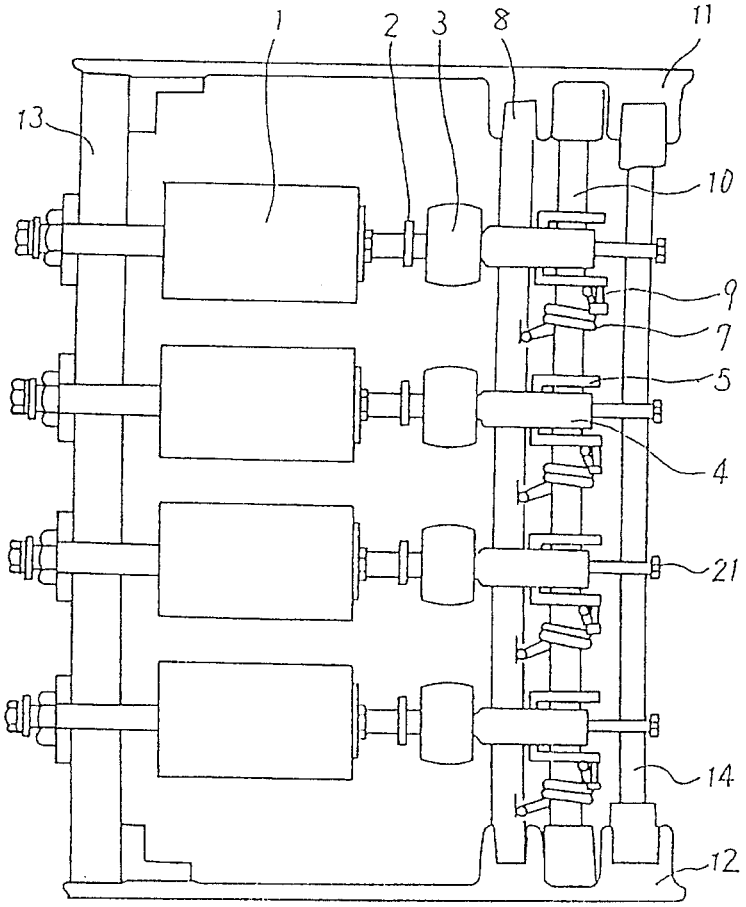
FIG. 2 is a side plan view of the vacuum switch bulb cassette of FIG. 1.
Figure 6:
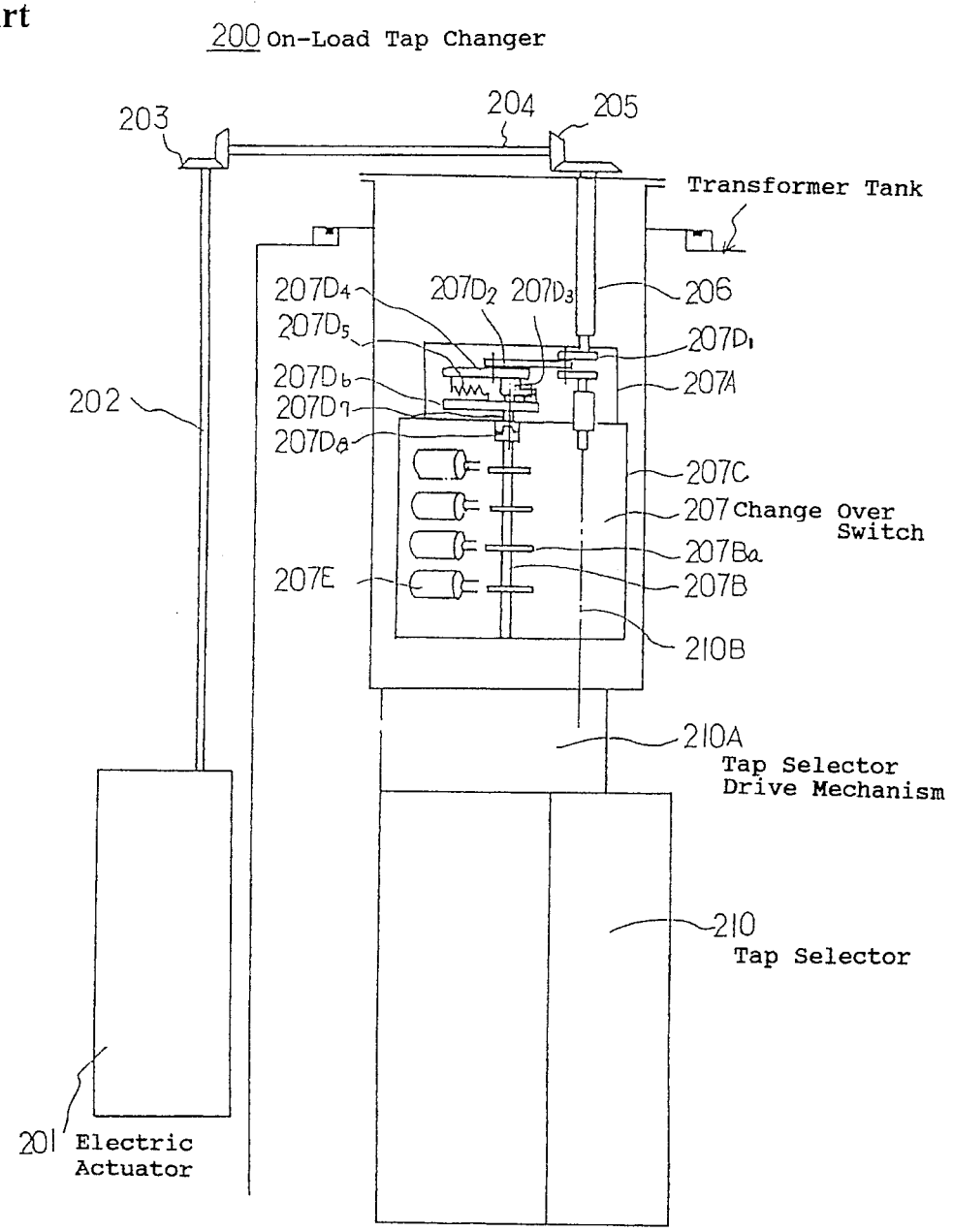
Fig. 6 Prior Art
FIG. 6 is a sectional view showing a structure of a change over switch for an on-load tap changer according to the prior art.
Figure 7:
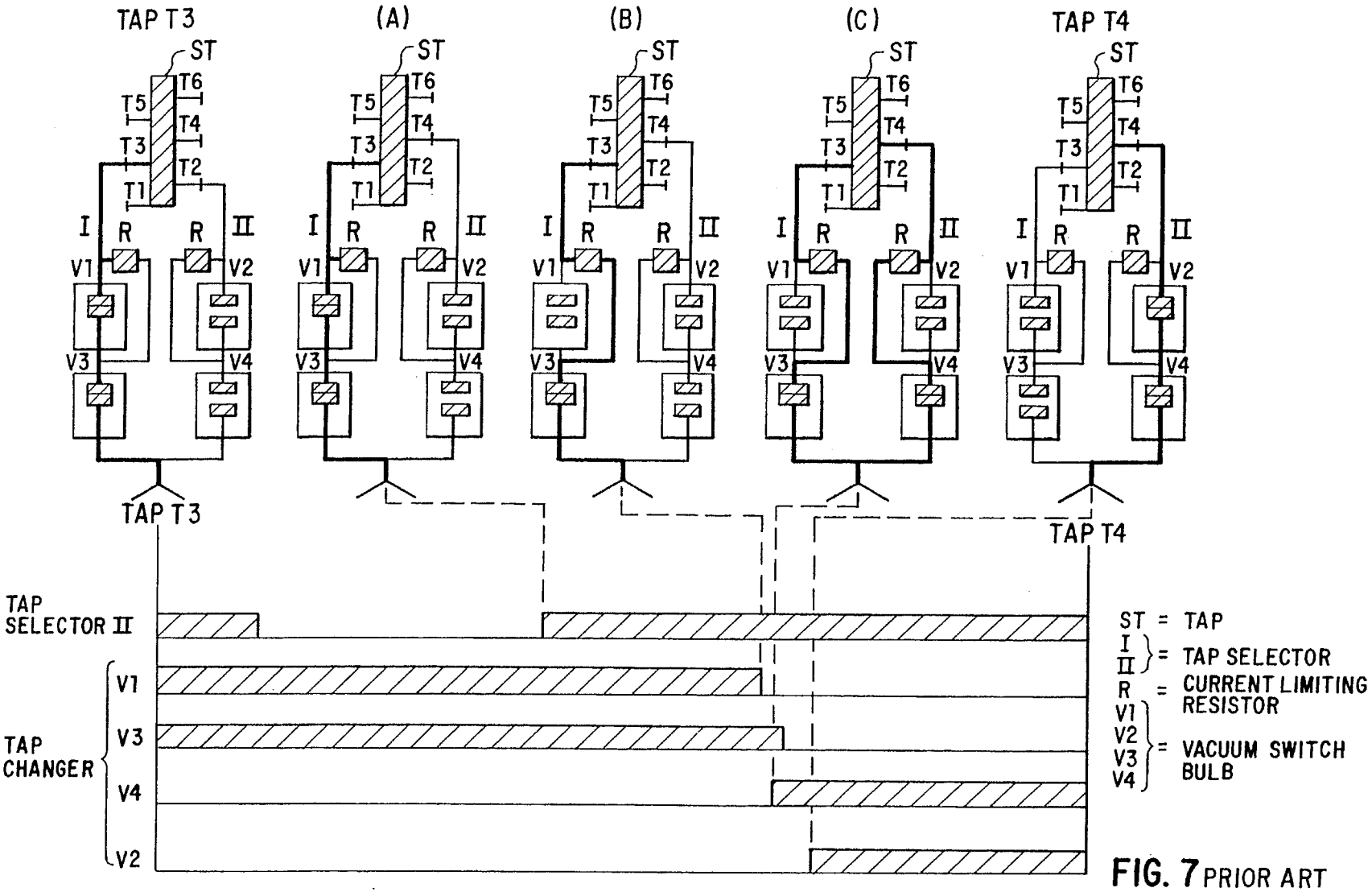
FIG. 7 PRIOR ART
FIG. 7 is an explanatory drawing for explaining the tap change over sequence in the on-load tap changer of FIG. 6.

FIG. 2 is a side plan view of the single phase switch cassette, and the same parts and members with those in FIG. 1 are designated by the same reference numerals. In FIG. 2, an upper frame 11 of the cassette is linked with a lower frame 12 by columns 8, 10, 13 and 14. The single phase switch is constructed into a flat and low cassette by aligning the vacuum switch bulbs parallel to the indispensable insulation clearance in between.

FIGS. 3 and 4 explain coupling between a cam plate 15 of the cam shaft constituting the common controller and the cam follower 6 on the top of the cam lever 5 of FIG. 1. The coupling between the cam plate 15 and the cam lever 5 brings a movable contact 19 in contact with a fixed contact 18, and separates the contacts 18, 19 from each other. FIG. 3 shows that the movable contact 19 contacts the fixed contact 18, wherein the cam follower is positioned on the convex portion 16 of the cam plate 15 and rotates the cam lever around the column 10 to the left hand side of the figure by overcoming the restoring force of the torsion spring 7 to bring the movable contact 19 in contact with the fixed contact 18. In FIG. 4, the cam follower is positioned on the concave portion 17 of the cam plate 15, so that the movable contact 19 is moved to the right hand side of the figure by the restoring force of the torsion spring 7, by which the movable contact 19 is separated from the fixed contact 18.

FIG. 5 is a top plan view showing three switch cassettes of FIGS. 1 and 2 for a single phase mounted on a cam shaft 22 with their cam followers 6 coupled with the cam plates 15 of the cam shaft 22 common to the three phases. The three single phase switch cassettes are arranged symmetrical around the cam shaft 22. By arranging the thin flat cassette so that its thickness direction orients along the radial direction of the cam shaft 22 (i.e. the width direction is directed along the rotation axis of the cam shaft 22), the three phase switch is compactly constructed. A current limiting resistor set 20 necessary for tap changing is disposed on the back of each cassette, as shown in FIG. 5.

The twelve vacuum switch bulbs of the three phase switch assembly are opened as shown in FIG. 4 before the single phase switch cassette is mounted on the cam shaft 22. While the operating on-load tap changer is carrying a current, some of the four vacuum switch bulbs at one phase are opened and the others are closed. And the some of the four vacuum switch bulbs perform from open to close operation, and the others perform from close to open operation at the time of the tap change over. Therefore, the positions of the four cam plates of the cam shaft 22 are adjusted one by one before the switch cassette is mounted on the cam shaft 22 so that some of the four cam plates may couple with some cam followers 6 at their convex portions and the other cam plates may couple with the other cam followers 6 at their concave portions.

Since the vacuum switch bulbs are opened before mounting as described above, the other cam followers 6 are easily coupled with the concave portion of the other cam plates 15. Though the some cam followers 6 are manually forced to couple with the some cam plates 15, it requires tremendous force to compress the torsion spring 7 to close the contacts of the vacuum switch bulb against the strong restoring force of the spring 7. This problem is solved by closing the contacts of all the vacuum switch bulbs as shown in FIG. 3 before the switch cassette is mounted on the cam shaft 22. To close the contacts of the vacuum switch bulb against the restoring force of the spring 7, a pushing screw 21 is temporarily mounted on a column 14 (a mounting portion) as shown in FIGS. 1 and 2. The contacts of the vacuum switch bulb are closed by pushing the movable contact 19 to the left hand side of the figures with the pushing screw 21 using the column 14 as a fulcrum. The pushing screw 21 is removed after three single phase switch cassettes are mounted on the cam shaft 22.

The change over switch of the present invention, which is formed of three single phase switch cassettes and a common controller onto which the switch cassettes are mounted independently, facilitates assembly of the change over switch as well as assembly of each switch cassette and the common controller. Since the switch cassettes can be dismounted independently from the common controller and inspected one by one or at the same time, the routine inspection can be conducted easily and quickly without causing mixing up the constituent components and parts, and mis-assembly. Since only a fault cassette can be replaced by a spare cassette, trouble shooting is completed in a short period of time.

In the change over switch, the common controller is formed of a cam shaft, each of the holding means is comprised of a cam plate mounted on the cam shaft, and three cassettes are mounted head to tail on a periphery of the cam shaft. This change over switch is assembled quite compactly, because the three cassettes are mounted side by side around the long cam shaft of the common controller with the small diameter. The switch cassette, in which the vacuum switch bulbs are aligned parallel in a plane, is flat in its thickness direction and short in the alignment direction of the vacuum switch bulbs. By mounting the flat switch cassettes in the length direction parallel to the circumferential direction of the cam shaft, the dimensions of the change over switch can be reduced in the radial and axial directions of the cam shaft. The thus compactly constructed change over switch and switch cassette with the small dimensions contribute to improved safety of the substations etc. by expanding leeway area around the transformers or the reactors.

The wiping spring disposed between the movable contact and its driving member suppresses chattering and prevents the change over switch from increasing its dimensions. Therefore, the contacts of the change over switch can be used for a long time to extend the life and to decrease the number of inspection of the change over switch. It contributes to stable supply of the electric power.

By providing the switch cassette with a mounting portion for temporarily mounting the jigs for pressing the movable contacts to the fixed contacts, the cam follower is easily coupled with the cam plate at the time of the change over switch assembly. As a result, the change over switch is always assembled accurately, the quality of the change over switch is maintained at high level, and the reliability of the change over switch is improved.

What is claimed is:

1. A vacuum switch bulb type change over switch for an on-load tap changer for changing taps in an on-load state comprising:

a plurality of single phase switch cassettes, each of the switch cassettes including a plurality of vacuum switch bulbs and a plurality of coupling means connected to said vacuum switch bulbs for actuating the same; and a common controller for the switch cassettes, said common controller including a plurality of holding means for holding said vacuum switch bulbs in an opened or closed state to thereby hold the taps of the switch, said single phase switch cassettes being independently mounted on and coupled with said common controller through said holding means.

2. A vacuum switch bulb type change over switch for an on-load tap changer as claimed in claim 1, wherein each of said single phase switch cassettes comprises three vacuum switch bulbs for a current limiting resistor.

3. A vacuum switch bulb type change over switch for an on-load tap changer as claimed in claim 1, wherein each of said single phase switch cassettes comprises four vacuum switch bulbs for two current limiting resistors.

4. A vacuum switch bulb type change over switch for an on-load tap changer as claimed in claim 1, wherein said common controller comprises a cam shaft;

each of said holding means comprises a cam plate mounted on said cam shaft; and three single phase switch cassettes are operably installed on a periphery of said cam shaft to be angularly spaced apart from each other.

5. A vacuum switch bulb type change over switch for an on-load tap changer as claimed in claim 4, wherein each of said vacuum switch bulbs comprises a movable contact and a fixed contact.

6. A vacuum switch bulb type change over switch for an on-load tap changer as claimed in claim 5, wherein said vacuum switch bulbs are aligned parallel in a plane in each of said single phase switch cassettes.

7. A vacuum switch bulb type change over switch for an on-load tap changer as claimed in claim 6, wherein each of said single phase switch cassettes comprises, a column arranged parallel to an alignment direction of said vacuum switch bulbs;

wiping springs for the respective vacuum switch bulbs, each of said wiping springs being disposed on each of said vacuum switch bulbs for pressurizing said movable contact to said fixed contact; and cam levers rotatably mounted on said column, each of said cam levers being urged by each of said wiping springs to contact said movable contact to said fixed contact.

8. A vacuum switch bulb type change over switch for an on-load tap changer as claimed in claim 7, wherein each of said coupling means comprises a cam follower disposed on each of said cam levers to contact each of said cam plates of said holding means.

9. A vacuum switch bulb type change over switch for an on-load tap changer as claimed in claim 8, wherein each of said single phase switch cassettes further comprises a mounting portion for temporarily mounting jigs for deforming said wiping springs, each of said jigs bringing said movable contact in contact with said fixed contact and positioning said cam follower on a portion of said cam plate while holding each of said vacuum switch bulbs in a closed state.

10. A vacuum switch bulb type change over switch for an on-load tap changer as claimed in claim 9, wherein said jig comprises a pushing screw for compressing each of said wiping springs.

* * * * *

UNITED STATES PATENT AND TRADEMARK OFFICE

CERTIFICATE OF CORRECTION

PATENT NO. : 5,594,223

DATED : January 14, 1997

INVENTOR(S) : Akira Fukushi, Tomio Yamaguchi

It is certified that error appears in the above-indentified patent and that said Letters Patent is hereby corrected as shown below:

Column 1, line 9, change "or change" to --or a change--; and line 10, delete "a" before "the".

Column 5, line 26, change "a" to --an--.

Signed and Sealed this

First Day of April, 1997

*Attest:*

*Attesting Officer*

BRUCE LEHMAN

*Commissioner of Patents and Trademarks*